United States Patent [19]

Yakushiji et al.

[11] 4,392,286

[45] Jul. 12, 1983

[54] APPARATUS FOR TAKING UP A BUNDLE OF FILAMENTS

[75] Inventors: Satoshi Yakushiji; Atsushi Yamamoto, both of Matsuyama; Yukio Kitamura, Kobe; Nobuo Yoshioka, Iwakuni, all of Japan

[73] Assignee: Teijin Limited, Tokyo, Japan

[21] Appl. No.: 229,940

[22] Filed: Jan. 30, 1981

Related U.S. Application Data

[63] Continuation of Ser. No. 892,418, Mar. 31, 1978, abandoned.

[30] Foreign Application Priority Data

Apr. 5, 1977 [JP] Japan ..... 52-38138

[51] Int. Cl.[3] ..... B65H 54/82

[52] U.S. Cl. ..... 28/289; 53/116

[58] Field of Search ..... 19/159 R, 299; 28/281, 28/289; 242/47, 82, 83; 226/7, 97; 156/167; 53/116, 430

[56] References Cited

U.S. PATENT DOCUMENTS

| | | | |
|---|---|---|---|
| 3,105,996 | 10/1963 | Naegeli | 19/159 R |
| 3,141,201 | 7/1964 | Gasser | 19/159 R |
| 3,387,756 | 6/1968 | Goodner | 28/289 X |
| 3,606,655 | 9/1971 | Oberlander et al. | 28/281 X |
| 3,644,968 | 2/1972 | Elliott et al. | 28/281 |
| 3,929,542 | 12/1975 | Gehrig et al. | 156/167 |
| 4,069,566 | 1/1978 | Sumitomo et al. | 28/289 |
| 4,109,357 | 8/1978 | Burow et al. | 28/289 |
| 4,153,212 | 5/1979 | Bauch et al. | 28/289 X |
| 4,221,345 | 9/1980 | Schippers et al. | 28/289 X |

FOREIGN PATENT DOCUMENTS

| | | | |
|---|---|---|---|
| 603130 | 8/1960 | Canada | 226/97 |
| 1115623 | 10/1961 | Fed. Rep. of Germany | 19/159 R |
| 1209030 | 1/1966 | Fed. Rep. of Germany | 19/159 R |
| 2344046 | 3/1974 | Fed. Rep. of Germany | 28/281 |
| 2452310 | 5/1976 | Fed. Rep. of Germany | 19/159 R |
| 39-35893 | 12/1964 | Japan . | |
| 46-20805 | 7/1971 | Japan . | |
| 51-105413 | 9/1976 | Japan . | |
| 51-133537 | 11/1976 | Japan . | |
| 1088931 | 10/1967 | United Kingdom | 19/299 |

*Primary Examiner*—Robert Mackey

*Attorney, Agent, or Firm*—Kenyon & Kenyon

[57] ABSTRACT

A method of taking up a bundle of filaments is disclosed wherein the bundle of filaments is ejected together with a compressed fluid toward a container and coils of the bundle of filaments are formed when the bundle of filaments is received in the container. Before arriving at the container, the above-mentioned compressed fluid is deviated from a passage of the bundle of filaments having a spiral shape. The apparatus for effectively carrying out this method comprises a rotary member rotating around the central line of the upstream portion of a guide passage for feeding the bundle of filaments toward the container and means, which ejects the bundle of filaments being conveyed into the rotary member in the above-mentioned upstream portion by means of a compressed fluid. The rotary member has a guide passage that expands gradually toward the outlet end of the guide passage. When the above-mentioned apparatus is operated, the bundle of filaments runs along the rearmost portion of the inside wall of the guide passage, which defines the running passage of the bundle of filaments, while the compressed fluid is separated from the above-mentioned bundle of filaments and discharged in a different direction.

17 Claims, 11 Drawing Figures

APPARATUS FOR TAKING UP A BUNDLE OF FILAMENTS

This is a continuation of application Ser. No. 892,418 filed Mar. 31, 1978, now abandoned.

BACKGROUND OF THE INVENTION (1) Field of the Invention

The present invention relates to a high-speed method and apparatus for taking up a bundle of filaments. More particularly, the invention relates to a method and apparatus in which a bundle of filaments is discharged in the form of coils from a rotary guide passage and coils of the bundle of filaments are accumulated in a container such as a can. The bundle of filaments is hereinafter refered to as "a filament-bundle" which means a bundle of individual filaments, such as a tow or multifilament yarn.

(2) Description of the Prior Art

In the process for preparing synthetic fibers, especially staple fibers, a number of filament-bundles produced in the spinning process are collected to form a tow which is received in a container such as a tow can. Subsequently at the drawing step, the tow is taken out of the tow can, drawn, subjected to a crimping-treatment or the like, and then cut to form staple fibers.

Recently, yarn spinning speed have been increased so as to enhance the manufacturing efficiency, until high-speed spinning at 2500 to 5000 m/min has been been tried. When a conventional method for collecting tows in tow cans, for example a nip reel method or a simple conventional coiler method, is applied to tows spun at such high speeds, it is impossible to collect the tows in tow cans in good order. Consequently, the tows become easily entangled when taken out at the subsequent step and such problems as wrapping the yarn around a roller or breakage of the yarn, cannot be avoided.

In the conventional nip reel method, since a filament-bundle such as a tow is caused to fall down into tow cans vertically, the tow sticks into layers of deposited tow at high speeds, and when the tow is taken out of the tow cans, it is entangled or entwined and cannot be removed normally in good order. On the other hand, in the conventional coiler method, as described in Japanese Utility Model Publication No. 35893/64 or Japanese Utilty Model Publication No. 20805/71, a rotating tube for guiding a bundle of fibers (called a sliver) is open at a bottom surface of a coiler wheel. If such a method is applied to accumulate the tow into a can at high running speed various disadvantages result, such as sticking of the deposited tow into layers previously deposited and formation of fluffs owing to bending of filaments at the outlet of the coiler. Furthermore, it is almost impossible to receive the coil of tow stably into the can.

In order to take up a synthetic fiber tow running at a high speed and store it in a can while overcoming the foregoing disadvantages involved in the conventional coiler apparatus, Japanese Patent Application Laid-Open Specifications No. 105413/76 and No. 133537/76 propose a method and an apparatus in which a tow running at a high-speed is sucked by a fluid ejector (air jet) and then discharged through a curved tube or tubular guide passage (tow guide tube) rotating coaxially with the ejector in the direction of the circumferential tangent, and the rotation direction of a tubular guide passage (coiler) is reversed relative to the tow discharge direction to counteract the running speed of the tow by the peripheral speed of the coiler, whereby coils of the tow can be stably formed. When such an apparatus or method is adopted, it is possible to take up a filament-bundle or tow at high speeds in the form of coils. However, the use of the apparatus in those Laid-Open Specifications still leaves certain problems to be solved.

In the first place, clogging or jamming of the guide tube is caused by entanglement of a bundle of filaments running in the guide tube. As a result of research conducted on causes of this undesirable phenomenon, the inventors of the present invention found that the main cause is that, since the guide tube having a circular section is curved, compressed air jetted from the fluid ejector and running in this guide tube swirls, and consequently, the filament-bundle also swirls as it runs in the guide tube. When modulatory waves of tension variation caused by the threading operation of the filament-bundle or tow are transmitted to the filament-bundle in the guide tube while swirling, turbulences are imparted to the swirling movement of the filament-bundle and the individual filaments thereof are caused to impinge against one another in the narrow space of the guide tube, instantaneously clogging the guide tube with entangled filaments.

In the second place, scratches, called "fluffs," are created on the individual filaments of the filament-bundle. More specifically, since the filament-bundle is prevented from running in the central portion of the guide tube because of the swirling of the compressed air and, instead, runs in rubbing contact with the inner wall of the guide tube, such scratches are created. Accordingly, the inner wall of the guide tube also extremely damaged. Furthermore, since the guide tube is curved, efforts to improve the abrasion resistance of the inner wall by a finishing treatment of the inner wall do not produce good results because it is very difficult to apply a uniform finishing treatment over the entire inner wall.

In the third place, compressed air jetted from the outlet of the guide tube together with the filament-bundle impinges against the bundle previously falling along a coil-like locus, and therefore, the coil formation of the filament-bundle is disturbed. In general, the fluid ejector imparts sufficient tension to the filament-bundle to prevent the filament-bundle from being wound on rollers at the upstream position of the passage. When the filament-bundle is taken up at a high-speed, the velocity of compressed air jetted from this fluid ejector is elevated to a subsonic level, and this speed is gradually reduced as the compressed air passes through the guide tube. However, when the compressed air is jetted from the outlet of the guide tube, its speed is still maintained at a level two to three times the running speed of the filament-bundle. Therefore, when compressed air jetted from the outlet of the guide tube impinges against previously released turns of the filament-bundle falling along a coil-like locus, the coil formation of the bundle of filaments is readily disturbed. Moreover, this compressed air jet separates individual filaments of the falling filament-bundle, resulting in a reduction of the cohesiveness of the filament-bundle.

Still further, when the thickness of the filament-bundle is small and the running speed of the filament-bundle is high, the above-mentioned disturbing effect of compressed air is enhanced. According to the conventional technique, in order to eliminate this disturbing effect, it is necessary that the diameter of formed coils should be very small, for example, 110 to about 150 mm. However, if the coil diameter is thus reduced, it is necessary to rotate the coiler wheel at an extremely high-speed. In this case, false twists are left on the filament-bundle at a rate of 2 to 3 turns per meter, and these false twists cause various troubles in the subsequent process, such as the drawing process. Also, the tow-coil falling down on the tow already deposited in the tow can has some momentum and tends to disturb the layer of the tow-coil in the can. This causes troubles when the tow is subsequently removed.

BRIEF SUMMARY OF THE INVENTION

It is a primary object of the present invention to provide a method for taking up a filament-bundle and to provide apparatus in which the above-mentioned problems can be effectively solved.

As a result of research and analysis conducted on the above-mentioned problems involved in the conventional technique, the inventors of the present invention have developed an epoch-making method and apparatus in which all of the above problems can be solved completely.

More specifically, in accordance with a first aspect of the present invention, there is provided a method for taking-up a filament-bundle which comprises: jetting a filament-bundle together with a compressed fluid while being rotated; allowing the filament-bundle to fall down into a container along a coil-like locus, and accumulating the filament-bundle in the container. A jet stream of the compressed fluid is separated from the filament-bundle as the latter moves along a coil-like locus so that the jet stream does not pass through the coil-like locus.

In accordance with a second aspect of the present invention, there is provided an apparatus for taking-up a filament-bundle. This apparatus comprises a rotary member having a guide passage formed therein and an ejector for sucking in a filament-bundle and blowing a compressed fluid together with the filament-bundle to one end of the guide passage of the rotary member. The guide passage of the rotary member includes a vertical passage open to the top end of the rotary member and a gradually spreading passage communicated with the bottom end of the vertical passage. The lower end of the spreading passage is opened to the peripheral face of the rotary member, and the cross sectional area of the spreading passage is expanded in the radial direction and is so shaped that the wall face of the leading portion of the spreading passage acts as a guiding face for the compressed fluid, alone, while the wall face of the trailing portion (with respect to the rotational direction of the rotary member) acts as a guiding face for the filament-bundle running into the container.

DETAILED EXPLANATION OF THE PRESENT INVENTION

For convenience of explanation, embodiments in which the filament-bundle take-up apparatus of the present invention is applied to a melt-spinning, direct drawing and winding system will be representatively illustrated.

Figure 1:
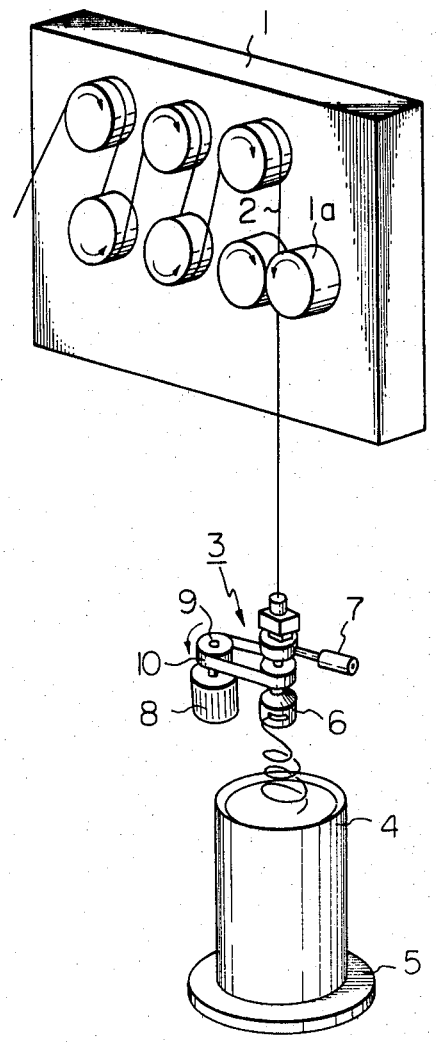
FIG. 1 is a schematic perspective view of the apparatus for taking up a filament-bundle, together with a series of take-up rollers, according to the present invention.

Referring to FIG. 1, a plurality of filaments spun from nozzles (not shown) of a spinning apparatus are appropriately cooled and collected into a tow 2. The tow 2 is then passed through a roller stand 1, including a plurality of godet rollers, and delivered from the roller stand 1 by means of a pair of delivery rollers 1*a*. Then, the tow 2 is guided by a take-up appartus 3 into a container can 4 placed on a stand 5, which, during the operation, is continuously rotated about its axes by a driving mechanism (not shown). The take-up apparatus 3 comprises a rotary member 6 having a guide passage (not shown) formed in the interior thereof and a fluid ejector 7 connected to the upper portion of the guide of the rotary member 6 to introduce the tow 2 into the guide passage. By the action of compressed air jetted from the fluid ejector 7, the tow 2 is carried out of the guide passage toward the container can 4. The guide passage has a shape that gradually widens toward the lower end portion of the rotary member 6. When the apparatus is in operation, the compressed air flows along a face that diverges outwardly from the locus of the guide passage that extends spirally toward the container can. The face along which the compressed air flows is formed on a part of the inner wall of the guide passage of the rotary member 6 being rotated.

Figure 2:
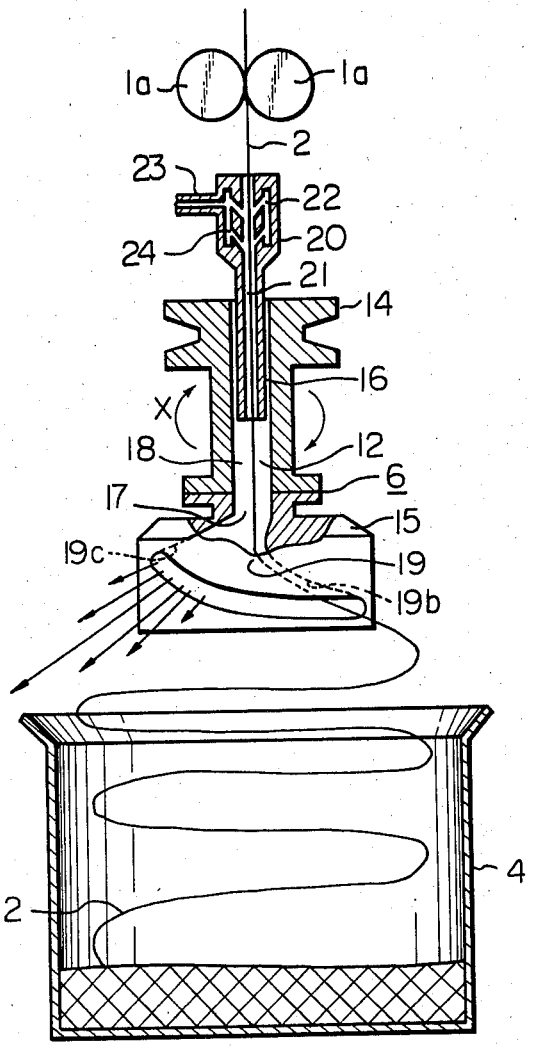
FIG. 2 is a schematic cross-sectional view of the take-up apparatus shown in FIG. 1.

The structure of the take-up apparatus according to the present invention is illustrated in detail in FIG. 2. Referring to FIG. 2, a pair of rotatable delivery rollers 1*a* are disposed to contact each other, and the rotary member 6 having a guide passage 12 in the interior thereof is below the delivery rollers 1*a*. This rotary member 6 comprises a pulley 14 and a coiler wheel 15 having the top end thereof fixed to the lower end of the pulley. The pulley 14 is connected to a driving source, for example, a motor 8, through a conductive pulley 9 and a belt 10, as shown in FIG. 1, and is arranged so that it is rotated in a direction indicated by arrow X in FIG. 2. A vertical hole 16 extends through the pulley from the top end face to the lower end face. A vertical hole 17 extends downwardly in the coiler wheel 15 from the top end face, where it communicates with he vertical hole 16 of the pulley 14. These vertical holes 16 and 17 form a vertical passage 18.

Figure 3:
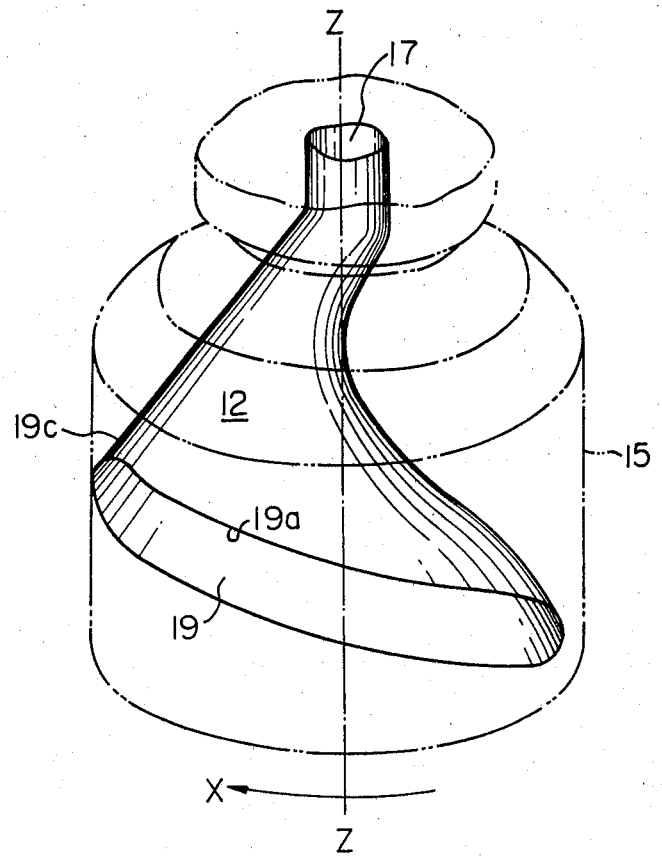
FIG. 3 is a perspective view of a rotary member adapted to the take-up apparatus shown in FIG. 2, showing a guide passage for a filament-bundle formed therein.

A downwardly spreading flat funnel-shaped passage 19 is formed in the coiler wheel 15 and is shown more clearly in FIG. 3. One end of this passage communicates with the lower end of the vertical hole 17 and the other end of the passage 19 is gradually expanded in the radial direction and inclined downwards and opens on the peripheral face of the coiler wheel 15. This gradually spreading passage 19 is arranged so that the radially outer end of its rear wall **19*b*, located at the rear with respect to the rotation direction of the coiler wheel 15, is positioned below the radially outer end of its front wall 19*c* which is located at the front with respect to the rotation direction of the coiler wheel 15. Further, the rear wall 19*b* is convexly curved so that it projects in the rotation direction to the coiler wheel 15 from a line connecting the inner radially end of the rear wall 19*b* to the outer radially end thereof. The above-mentioned vertical passage 18 and this gradually spreading passage 19 together form the guide passage 12. The inner wall of this guide passage 12** may be surface-treated with a hard chromium plating or ceramic coating according to need.

Referring to FIG. 2 again, a stationary ejector 20 is disposed between the delivery rollers **1*a* and the rotary member 6 in such a way that the lower end portion of the ejector 20 is freely fitted to one end of the vertical hole 16 through the pulley 14. A passage 21 extends along the longitudinal axis of the ejector, and an annular chamber 22 is formed in the interior of the upper portion of the ejector 20 surrounding the passage 21 and is connected by a pipe 23 to a compressed fluid supply source (not shown). A plurality of jetting passages 24 connect the annular chamber 22 with the passage 21. Consequently, the compressed fluid supplied from the compressed fluid supply source through the pipe 23 and annular grooves 24 is jetted downwardly into the passage 21 to pull the tow 2 along at a high speed, for example, 2500 to 5000 m/min. A container can 4 having a circular section is located below the rotary member 6 on the rotary stand 5, and the tow 2 is stored in the container can 4** in a coiled condition.

Figure 6:
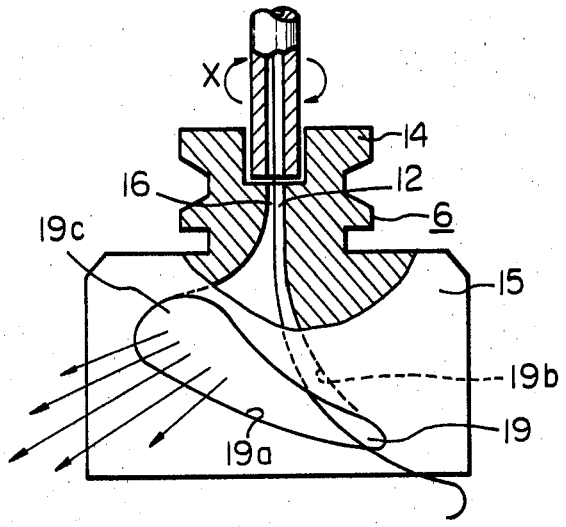
FIGS. 6 and 7 are perspective views of rotary members which are modifications of the rotary member shown in FIG. 3, respectively.
Figure 7:
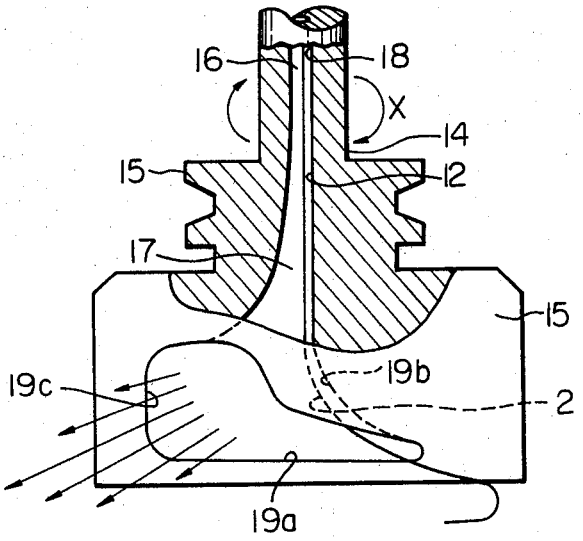

The gradually spreading passage 19 shown in FIGS. 2 and 3 is shaped so that the width of the opening is substantially identical from the side of the front wall **19*c* to the rear wall 19*b*. However, in the present invention the gradually spreading passage 19 is not limited to this shape, but any type of passage 19 having a shape spreading gradually downwardly in the circumferential direction of the coiler wheel 15 can be used. For example, the passage 19 may be shaped in such a way that the height of the opening of the passage 19 at the side of the front wall 19*c* is larger than the height of the opening of the passage 19 at the rear wall 19*b*, as shown in FIGS. 6 and 7. In this condition, the discharge of air from the front wall 19*c*** can be promoted.

The operation of the above-mentioned yarn take-up apparatus according to the present invention will now be described in detail.

A compressed fluid is supplied from a source (not shown) and jetted downwardly into the passage 21 through the pipe 23, the annular chamber 22 and the jetting passages 24. At this point, the rotary member 6 is rotated in the direction of an arrow X by the above-mentioned driving mechanism. The tow 2 is passed between the delivery rollers **1*a* and the end of the tow is led into the passage 21, where it is carried downwardly by a frictional force of the compressed fluid supplied into the passage 21 and is then jetted into the passage 12 together with the compressed fluid. This places tension on the tow 2 and prevents it from being wrapped on rollers upstream of the ejector 20 for example, delivery rollers 1*a*. The compressed fluid carries the tow through the passage 12 to the opening at the other end of that passage. At this point, since the passage 19 has an inclined flat funnel-shaped configuration, the compressed fluid passing through the gradually spreading passage 19 does not swirl. Further, the tow 2 passing through the gradually spreading passage 19 is attracted to the main stream portion of the compressed fluid flowing at a high speed and, therefore, the tow 2 runs along a passage slightly separated from the rear wall face 19*b* shown in FIGS. 4 and 5. The compressed fluid jetted from the opening at the lower end of the guide passage 12 has component air flows having the speed distribution represented by the arrows in FIG. 5. Owing to the momentum of the tow 2 and the resistance of air, the tow 2 discharged from the opening on the other end of the guide passage 12 is caused to run along near the rear wall 19*b* of the gradually spreading passage 19**. This delay of the rotation is greatly influenced also by the tension and the centrifugal force of the preceding tow already discharged.

When the tow 2 is thus discharged from the opening at the outer end of the guide passage 12, it helically falls down into the container can 4 along a coil-like locus. At this point, since the tow 2 is separated in the circumferential direction from the main stream portion of the compressed fluid jetted, the compressed fluid does not impinge against the tow as the toro falls along a coil-like locus. Especially in the case where the rear wall **19*b* of the gradually spreading passage 19 is lower than the front wall 19*c*, as shown in FIG. 3, the tow 2 is also separated vertically from the compressed fluid jetted from the opening on the outer end of the guide passage 12**, so that the above effect is further enhanced.

The kind of filament-bundle to which the present invention can be applied is not particularly critical, but especially good results can be expected when it is used on a synthetic-fiber tow having a total denier of 5000 to 200,000 denier carried along at a high speed, for example, 2500 to 5000 m/min. During experimental testing conducted by the inventors of the present invention, it was found that the influence of an oiling agent adhered on the individual filaments of the tow can not be neglected in the take-up operation of the tow. Therefore, the inventors tried to find a solution regarding the oiling agent and its condition, and it was found that, if the oiling condition is carefully selected, the possible troubles in the subsequent processes, such as a drawing process of the take-up tow can be reduced. In addition a very stable take-up operation of the tow can be established. That is, if the percentage by weight of the oiling agent (O.P.U.) adhered on the take-up tow is maintained in a range between 0.10% and 0.50%, and the value of E.P.U. (%)×O.P.U.(%) is maintained at more than $4.0\times10^{-5}$, wherein E.P.U.(%) represents the emulsion of the oiling agent adhered on the filament-bundle at the time of the drawing operation (in weight %), a very desirable taking-up stability of the filament-bundle and a good process stability in the subsequent process can be expected. If the O.P.U. is less than 0.10%, since the two is injured by the abrasion of the surface of the guide passage formed in a coiler head, the individual filaments of the tow are possibly broken in the subsequent process. On the other hand, if the O.P.U. is more than 0.50%, the oiling agent is possibly adhered on the surface of the guide passage formed in the coiler head when the filament-bundle is taken-up, and consequently, it becomes impossible to take-up the filament-bundle in a stable condition. It must be realized that the quantity of the oiling agent scattered from the filament-bundle is also increased, and consequently the loss percentage of the oiling agent becomes large. With respect to the E.P.U., if the E.P.U. is less than 0.50%, it is quite possible that a fluffy tow will be created when the tow is taken up, and if the E.P.U. is more than 10%, the capability of taking-up the tow is reduced because the load imparted to the fluid ejector is increased. Furthermore, if the product of the O.P.U.(%) and E.P.U.(%) is less than $4.0\times10^{-5}$, that is, in the condition $O.P.U./100\times E.P.U./100<4.0\times10^{-5}$, even though no particular trouble is encountered in taking up the tow, such a condition is not preferable since the individual filaments of the tow are easily broken.

The foregoing illustration shows that a compressed fluid passing through the guide passage does not swirl, and therefore clogging of the passage with the filaments can be completely prevented by the present invention. Further, since the tow runs along its passage out of contact with the wall surface of the guide passage, formation of fluffs thereof can be remarkably diminished. Moreover, since the compressed fluid jetted from the opening of the guide passage does not impinge against the tow falling down from the bottom opening of the guide passage along a coil-like locus, formation of coils of the tow is not disturbed at all by the compressed fluid. Still further, extreme separation of individual filaments from one another in the tow is prevented and the cohesiveness of the tow can be remarkably improved.

EXAMPLE

A polyester tow having a total denier of 56,000, composed of individual filaments of 2.14 denier, was spun from a melt-spinning apparatus having 36 spinnerets, each spinneret having 720 holes, at an extrusion rate of 600 g/min and a spinning speed of 3500 m/min. The tow was received in a container can by using the take-up apparatus of the present invention shown in FIG. 2, wherein the rotary member 6 was rotated at a rate of 3700 rpm. For comparison a polyester tow was spun and taken up under the same conditions as described above except that the apparatus disclosed in Japanese Patent Application Laid-Open Specification No. 133537/76 was used as the take-up apparatus.

In the comparative experiments, the apparatus of the present invention was compared with the above-mentioned conventional apparatus with respect to the frequency of occurrence of clogging of the rotary member of the take-up apparatus with filaments, the disturbance in formation of coils of the tow, the cohesiveness of individual filaments in the tow and the number of fluffs created in the tow.

With respect to each run, twenty cans were prepared and subjected to the creeling operation to collect 20 tows, and they were treated by a drawing apparatus and drawn at a draw ratio of 1.7 and a drawing speed of 170 m/min, under ordinary dry-drawing condition, whereby a drawn tow having 659,000 denier was formed from 20 tows, each having 56,000 denier. The frequency of stoppage of the drawing apparatus owing to entanglement of individual filaments and the state of creation of the fluffs in the drawn tow were examined.

Results of the above comparative tests are shown in Table 1.

In Table 1, "creation of fluffs" was determined by measuring the number of broken individual filaments in randomly sampled tows having a length of 1 m, calculating an average value of measured values obtained from 50 samples and converting the average value to a number of fluffs per 100,000 filaments. Further, "disturbance in formation of coils" and "cohering property" were evaluated by visual observation by experts.

TABLE 1

| Item | Unit | Present Invention (FIG. 2) | Japanese Patent Application Laid-Open Specification No. 133537/56 |
|---|---|---|---|
| Number of Fluffs on Taken-up Tow | fluffs per 100,000 filaments | 0–5 | 300–600 |
| Number of Fluffs on Drawn Tow | fluffs per 100,000 filaments | 0–8 | 500–800 |
| Frequency of Occurrence of Clogging of Rotary Member 6 | times per day | 0 | 3–5 |
| Disturbance of Coil formation | | not disturbed | remarkably observed |
| Cohesiveness of Tow | | good | bad |
| Frequency of Stoppage of Drawing Apparatus by Entanglement of Tow | times per day | 0–2 | 30–50 |

As will be apparent from the foregoing illustration, all the problems involved in the known take-up apparatus for a synthetic filament-bundle and having previously been required to be solved can be solved completely by the take-up apparatus of the present invention. Furthermore, the apparatus according to the present invention is characterized in that desired coils of a tow can be formed while preventing compressed air streams from providing influences on the tow falling down along a helical path. This characteristic feature will now be described in more detail with respect to specific structural aspects by reference to FIGS. 8 and 9.

Figure 8:
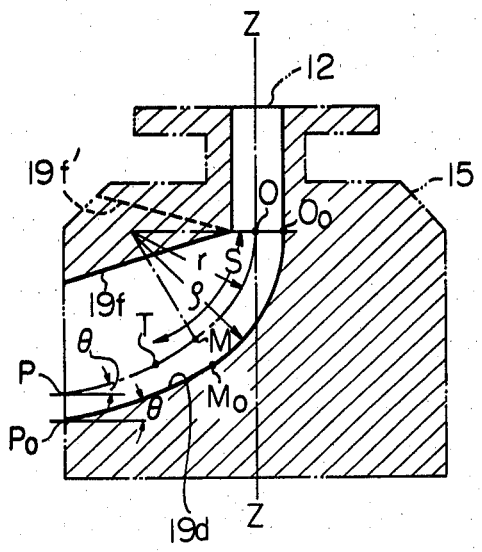
FIG. 8 shows a projection of the guide passage formed in the rotary member shown in FIG. 2; on a vertical plane that coincides with the longitudinal axis of the rotary member.

In FIG. 8, a vertical projection of an imaginary running locus of the tow 2 is shown when the tow 2 is ejected in the state where the rotary member 6, that is the coiler wheel 15, is kept stationary.

In this state, the tow 2 runs along the bottom wall surface 19*d* of the passage 19, and the center of the tow 2 traces a locus $\widehat{OP}$. The shape of the bottom wall surface 19*d* is designed so that the locus of the center of the tow 2 traces a circular arc $\widehat{OM}$ and a line $\widehat{MP}$. The bottom wall surface 19*d* is formed by two portions OoMo and MoPo connected to each other. The portion OoMo corresponds to the arc $\widehat{OM}$ and is provided with a shape of a circular arc of curvature radius $\rho$ while the portion MoPo corresponds to a line having an angle $\theta$ to a horizontal plane which is perpendicular to the longitudinal axis of the coiler wheel 15. The tow 2 runs along the bottom wall face 19*d* and at the point 0, the running direction of the tow 2 begins to change from the vertical direction to the radial direction. Accordingly, it is generally preferred that the curvature radius $\rho$ at this turning point be at least 30 mm, though the preferred curvature radius $\rho$ varies to some extent depending of the running speed, shape and size of the tow. In order to form stable coils of the tow 2, it is preferred that the angle 0 defining the angle of discharge of the tow 2 be in the range of from 5 to 50°.

Figure 9:
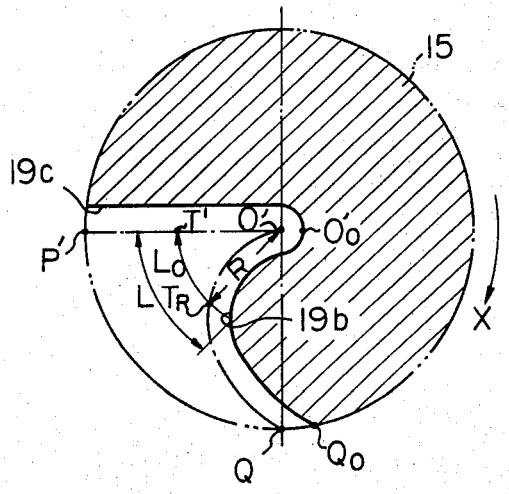
FIG. 9 shows, on a horizontal plane perpendicular to the longitudinal axis of the rotary member, a projection of the guide passage formed in the rotary member in FIG. 2.

Referring to FIG. 9, with rotation of the rotary member 6, that is, the coiler wheel 15 in a direction X, the tow 2 runs along the rear wall face 19*b* and ideally, the locus of the center of the tow 2 traces a locus $\widehat{O'Q}$ corresponding to the remainder left after taking the radius of the tow 2 from the rear wall face 19*b*.

The horizontal projection locus $\widehat{O'Q}$ of the tow and the shape $\widehat{Oo'Qo}$ of the rear wall surface 19*b* are determined as described below.

In FIG. 8, supposing that the distance to an optional point T on the vertical projection locus $\widehat{OP}$ of the tow 2 from the point O is S (mm), the predetermined speed of the tow is Vo (mm/sec) and the predetermined rotational speed of the coiler wheel 15 is $\omega o$ (radian/sec), the distance Lo from the projection of the point T on the locus OP, corresponding to the point T' on the projection radius $\overline{O'P'}$ (FIG. 9), to the running locus $\widehat{O'Q}$ (FIG. 9) of the tow 2 in the circumferential direction is approximately represented by the following formula:

$$Lo = \frac{\omega o}{Vo} \cdot S \cdot R \qquad (1)$$

wherein R represents the distance from the center O' to the point $T_R$, on the locus corresponding to the point T' on the projection radius, which is equal to the distance O'T' (mm) on an imaginary radius $\overline{O'P'}$.

When the movement of the tow 2 is considered while neglecting the frictional force between the tow 2 and the inner surface of the guide passage of the coiler wheel 15 and the centrifugal force of the tow 2, the running locus of the tow 2 can be regarded as a composite movement of a motion of uniform speed along the imaginary arc $\widehat{OP}$ and movement by the rotation of the coiler wheel 15. Accordingly, the horizontal projection locus of the tow 2 can be regarded as a composite locus of movement of the tow 2 at speed Vo in the radial direction and movement thereof in the circumferential direction retreating at an angular speed $\omega o$ relative to the rotation of the coiler wheel 15 in the direction X. Supposing that when the tow 2 arrives at the point T on the locus $\widehat{OP}$ (FIG. 8) in the direction of the imaginary radius, the displacement in the circumferential direction is Lo', the displacement Lo' is given by a product of the displacement angle and the radius O'T'. More specifically, the displacement Lo' is represented as follows:

$$Lo' = \omega o \times \frac{S}{Vo} \times O'T' = \omega o \times \frac{S}{Vo} \times R = \frac{\omega o}{Vo} \times S \times R$$

This Lo' is identical to the Lo given above. Accordingly, the horizontal projection line of the running locus of the tow 2 takes a place along a curve which approximates to Lo given by the above formula (1).

The horizontal projection shape of the rear wall surface 19*b* of the passage 19 is designed so that the distance L from the projection radius $\overline{O'T'}$ to the horizontal projection plane of the bottom wall surface 19*c* in the circumferential direction in FIG. 9 is in the following range based on Lo:

$$\frac{1}{0.6} Lo \geqq L \geqq \frac{1}{1.1} Lo \qquad (2)$$

The reason L is set in the above range is that Lo is an approximate calculation value and, when such factors as the thickness of the tow, friction on the tow to the wall surface of the guide passage 19 and the centrifugal force imposed on the tow 2 in the actual operation are taken into consideration, it is seen that, when L is in the above range, a practically optimum shape can be formed. More specifically, if $$L < \frac{1}{1.1} Lo,$$

friction between the tow 2 and the rear wall surface 19*b* would be large and the tow 2 would be damaged. Accordingly, there would be a risk that troubles would be caused when the tow 2 was drawn in the subsequent process. Further, if $$L > \frac{1}{0.6} Lo,$$

since the area of the opening of the spread guide passage would be too large, it would be difficult to maintain a good balance in rotation of the coiler wheel 15, and since the tow 2 would be discharged in the state separated greatly from the rear wall surface 19*b*, the tow 2 would be readily influenced by discharged air, resulting in insufficient cohering of filaments of the tow 2 and formation of unstable coils of the tow.

When the rear wall surface is not a smooth curved surface, turbulences are caused in the stream of discharging air, and such troubles as insufficient cohering of filaments of the tow 2 and formation of unstable coils of the tow take place. Accordingly, it is necessary that the rear wall should have a smooth continuous curved surface free of convexities or concavities and that the shape of the rear wall surface should satisfy the requirement represented by the above formula (2).

When the horizontal projectional configuration of the rear wall surface 19*b* is determined according to the above-mentioned principle, the shape of the standard imaginary radius locus (vertical projection locus), namely the shape of the bottom wall surface 19*d*, is first set and the distance L from the horizontal projection locus of the imaginary radius locus to the horizontal projection locus of the rear wall surface 19*b* in the circumferential direction is then set according to the formula (2) to determine the shape or configuration of the rear wall surface 19*b*.

When the distance L is determined according to the formula (2), the predetermined speed Vo (mm/sec) of the tow 2 and the predetermined rotation speed $\omega$·(-radian/sec) of the coiler wheel 15 are set as follows.

It is preferred that the predetermined speed Vo of the tow 2 be set in the range of $2.5\times10^4$ to $8.3\times10^4$ mm/sec, though a preferred value varies to some extent depending on the kind of the spun tow. In case of $Vo<2.5\times10^4$ mm/sec, it is difficult to obtain stable coils of the tow according to the apparatus of the present invention, and in case of $Vo>8.3\times10^4$ mm/sec, in order to obtain stable coils of the tow, it is necessary to increase the predetermined rotation speed $\omega o$ of the rotary member 6 drastically, and consequently equipment troubles may be created.

When the predetermined rotation speed $\omega o$ of the rotary member 6 is then set, and optimum diameter of the tow coils is first determined after due consideration of the specifications of the cans in which the tow is to be received, the falling distance of tow coils, the denier of the tow and the predetermined speed of the tow. In general, it is preferred to determine this optimum coil diameter based on experiments. Then the predetermined rotation speed $\omega o$ (radian/sec) of the rotary member 6 is calculated according to the following formula derived from the predetermined speed Vo (mm/sec) of the tow 2 and the predetermined diameter D (mm) of the tow coils in the light of the relation to the continuity of the tow:

$$\omega o = 2Vo \cos \alpha / D \quad (3)$$

where $\alpha$ represents an angle of the tow as-discharged from the coiler wheel 15 to the horizontal plane, and this angle $\alpha$ can be approximately substituted by the angle $\theta$ which is the inclination angle of the coiler wheel shown in FIG. 8.

The predetermined speed Vo of the tow 2 and the predetermined rotation speed $\omega o$ of the rotary member 6, that is the coiler wheel 15, are set according to the above-mentioned methods. A specific example will now be described, with reference to the apparatus shown in FIGS. 2 and 3.

A 50,000 denier tow is fed to the rotary member 6 at a predetermined speed of $5.83\times10^4$ mm/sec, and tow coils discharged from the coiler wheel 15 are received in a bottomed can 4 having a cylindrical shape with an inner diameter of 80 cm and a height of 1.6 m, which is located 2 m below the coiler wheel 15. An optimum rotation speed of the coiler wheel 15 is first set by experiments. In this example, as a result of examination of the stability of tow coils and the state of receiving the tow coils in the can 4, it has been found that a preferred tow coil diameter D is 270 mm. When the tow coil diameter is too large, the stability of the coils is reduced. For example, when the tow coil diameter D is 350 mm, disintegration of coils takes place at a point 1 m below the coiler wheel 15, and the receiving condition becomes worse in the bottom portion of the can 4 below this point. When the coil diameter is too small, for example, 200 mm, the formed coils are stable, but rotary movement of the tow 2 is caused in the coils when they are deposited in the can 4 and the receiving condition of the tow 2 become worse. When the optimum coil diameter of 270 mm is substituted in the formula (3), $\omega o$ becomes equal to 406 radian/sec. Incidentally, in this case, the inclination angle $\theta$ of the coiler is set at 0.349 radian.

In the above-mentioned example, the front wall surface 19*c* of the passage 19 is formed to extend in the radial direction. However, as will be apparent from the above-mentioned explanation, the shape or configuration of this front wall surface 19*c* is not particularly critical, as long as the running tow can be effectively separated from the stream of jetted compressed air.

Figure 10:
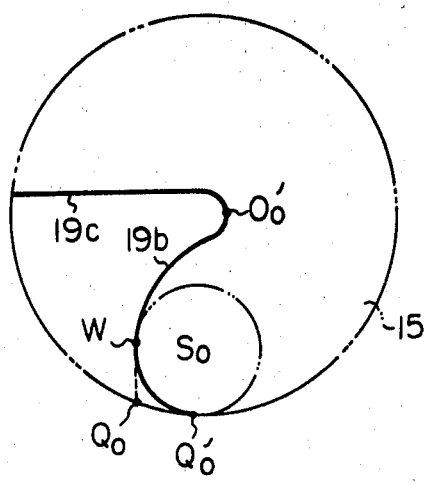
FIG. 10 shows a projection of a part of the inner wall of the guide passage formed in the rotary member in FIG. 2, which is the rearmost side thereof with respect to the rotational direction of the rotary member, on a horizontal plane perpendicular to the longitudinal axis of the rotary member.

If desired, a modification of the passage 19 shown in FIG. 10 may be adopted. In an embodiment shown in FIG. 10, in the horizontal projection configuration of the rear wall surface 19*b*, the shape of the rear wall surface 19*b* on the outlet side is arranged so that the opening is increased by relocating the outlet of the wall surface 19*b* to the peripheral line of a circle inscribed by the rear wall surface 19*b* and the periphery of the coiler wheel 15 at points W and Q'o, respectively. In this case, however, the diameter of the circle So is less than $\frac{1}{3}$ of the outer diameter of the coiler wheel 15. In this embodiment, the horizontal projection locus of the rear wall surface 19*b* is expressed as O'oWQ'o. In the case of a coiler wheel 15 having such a rear wall surface, when the tow is discharged from the coiler wheel 15, contact between the tow and the rear wall surface in the outlet portion of the coiler wheel 15 is substantially eliminated. As a result, separation of individual filaments of the tow 2 can be effectively prevented and tow coils that have excellent stability and cohesiveness of individual filaments of the tow 2 can be attained.

Figure 11:
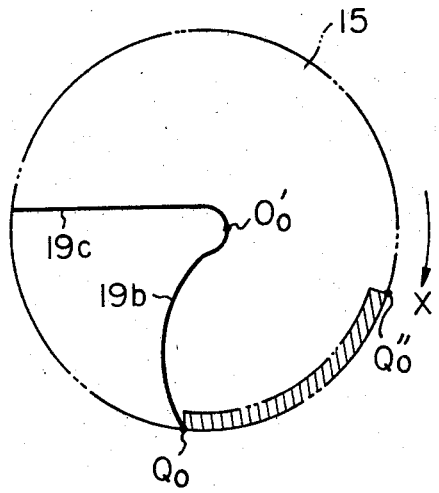
FIG. 11 shows a projection of a part of the inner wall of a guide passage formed in a modified rotary member according to the present invention, which is the rearmost side thereof with respect to the rotational direction of the rotary member on a horizontal plane perpendicularly to the longitudinal axis of the rotary member.

If desired, further modification of the yarn passage 19 as shown in FIG. 11 may be adopted. In the horizontal projection configuration of the coiler wheel 15 shown in the embodiment in FIG. 11, a hatched portion of the coiler wheel 15 extending from the intersecting point Qo of the rear wall surface 19*b* and the periphery of the coiler wheel 15 toward the side opposite to the rotation direction X thereof is cut off at a depth exceeding 5 mm. It is preferred that the width of the cut portion, or groove, in the vertical direction be substantially equal to the width of the tow 2 and the length Qo Q''o in the horizontal direction be in the range of from $\frac{1}{8}$ to $\frac{1}{2}$ of the peripheral length of the coiler wheel 15. In this embodiment, since contact of the tow 2 with the peripheral wall of the coiler wheel 15 is substantially eliminated when the tow 2 is discharged from the coiler wheel 15, it is possible to attain the advantages of effectively preventing separation of individual filaments of the tow 2 and of forming stable coils having a good cohesiveness of the tow 2.

In the apparatus of the present invention, friction of the running tow with the wall surface of the spread yarn passage can be remarkably reduced and the tow is hardly scratched by such friction, but wearing of the wall face of the guide passage cannot be avoided when the apparatus is used for a long time. In order to eliminate wearing of the wall surface of the guide passage, it is preferable to coat the passage with a ceramic or diamond coating. In order to attain smooth running of the tow and reduce friction, it is preferable that the surface roughness be arranged so that it is about 0.5 to about 5 S, as specified in Japanese Industrial Standard (JIS) No. B0601. Since the guide passage has a complicated curved configuration, coating or surface finishing is very difficult, and in case of conventional tubular passages, such surface treatment is substantially impossible. However, in the apparatus of the present invention, since guiding of the filament-bundle, such as a tow, is performed by the rear wall face 19*b* and the bottom wall face 19*d*, the configurations of both the front wall surface 19*c* and the top wall surface 19*f* may optionally be decided, as long as the filament-bundle is separated from the stream of compressed air. When the rear wall surface 19*b* and bottom wall surface 19*d* of the guide passage are coated with a ceramic or diamond coating, this surface treatment can be remarkably facilitated if the top wall surface 19*f* is opened above the turning point 0 of the tow 2, as indicated by a dotted line (19*f*') in FIG. 8, and the abrasion resistance of the wall surface of the passage can be improved without undesirable influences on the guiding capacity for the filament-bundle or separation of the filament-bundle from the compressed air.

The shape or configuration of the bottom wall surface 19*d* has a large influence on the guiding of the filament-bundle, such as a tow, and formation of coils thereof. With regard to the configuration of the bottom wall surface, it has already been pointed out that it is preferred that the radius of curvature and inclination angle $\theta$ shown in FIG. 8 be at least 30 mm and in the range of from 5 to 50°, respectively. The reasons for this are as follows.

When the radius of curvature $\rho$ is smaller than 30 mm, the shock imposed on the filament-bundle at the turning point (0oMo) is large and the filament-bundle is seriously damaged, resulting in breakage of individual filaments in subsequent processes. Accordingly, a larger value of the radius of curvature $\rho$ is preferred, but from the viewpoint of diminution of the coiler wheel 15, it is preferred that the radius of curvature $\rho$ be in the range of from 40 to 150 mm. When the inclination angle $\theta$ is smaller than 5°, the vertical distance between every two adjacent coils formed is very narrow. As a result, the receiving condition of the coils is readily influenced and made unstable by disturbances, and troubles are readily caused when the filament-bundle is taken out from the container can in the subsequent process. When the inclination angle $\theta$ is larger than 50°, the falling speed of the coils of the filament-bundle becomes too high (because a downward component of the speed becomes large), and the coils are disturbed and disintegrated before they arrive at the deposited coils in the can. Further, since also the jet stream of compressed air is directed downwards, it disturbs the smooth falling of the coils of the filament-bundle. Accordingly, such troubles as entanglement are often caused when the filament-bundle is taken out from the can in the subsequent process.

Figure 4:
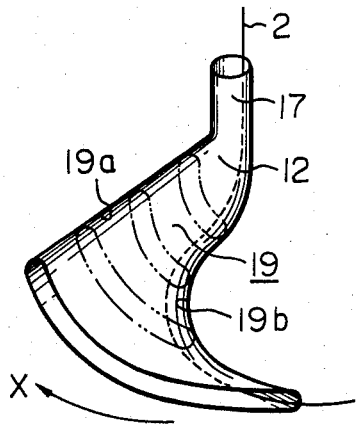
FIG. 4 is a perspective view of the guide passage shown in FIG. 3.
Figure 5:
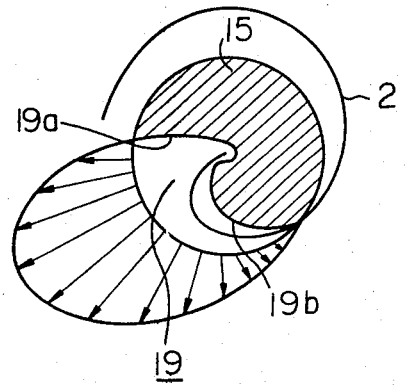
FIG. 5 is a diagramatic representation of the speed distribution of the components of the jetting fluid in the guide passage shown in FIG. 4.

In the embodiments illustrated in FIGS. 2, 3 and 4, the discharge opening of the guide passage is inclined downwards toward the rear wall surface and the width is made equal throughout the entire length. In this case, as will be apparent from FIGS. 4 and 5, the position of the jet stream of compressed air and the position of the discharged filament-bundle differ from each other also with respect to the vertical direction. Accordingly, good separation can be attained between the filament-bundle and air. However, the shape of the discharge opening is not limited to the one shown in the drawings. For example, in order to enhance separation of the filament-bundle from the jet stream of air, it is possible to adopt a design in which the width of the discharge opening is increased at a part close to the front wall surface 19*c*.

What we claim is:

1. An apparatus for taking a bundle of filaments from a supply source thereof in a container, the apparatus including a rotary member mounted for rotation about a vertical axis and having a guide passage formed therein, the guide passage extending from an entrance opening coaxial with the vertical axis at the top of the rotary member to a discharge opening displaced downwardly and radially outward from the entrance opening, means for rotating the rotary member about the vertical axis in a predetermined direction, and an ejector for sucking in a bundle of filaments from a supply source and delivering the bundle of filaments in a stream of compressed air into the entrance opening of said guide passage for ejection from the discharge opening thereof along a spiral locus, wherein the improvement comprises:

said guide passage of the rotary member including a vertical upper portion extending from the entrance opening at the top of the rotary member; and a lower portion comprising a gradually spreading passage having a front wall with respect to the rotational direction of said rotary member extending from a turning point at the lower end of the vertical upper portion to the discharge opening of the guide passage on a peripheral face of said rotary member and a rear wall extending downwardly and outwardly from said turning point at the lower end of the vertical upper portion, the position of said rear wall at said discharge opening being located below the position of said front wall at said discharge opening, the rear wall of said gradually spreading passage diverging smoothly and continuously from the front wall with increasing distance in the radial direction such that said filament-bundle is guided along the rear wall of said lower portion of the guide passage, while said compressed air stream is discharged along the front wall of said lower portion of the guide passage, whereby the discharged air stream is diverted from the path followed by the ejected bundle of filaments.

2. The invention as defined in claim 1 wherein said rear wall of said gradually spreading passage is smoothly convexly curved toward the rotational direction of said rotary member.

3. The invention as defined in claim 1 wherein the horizontal projection of the surface of said rear wall of said gradually spreading guide passage is formed to satisfy the requirement:

$$\frac{1}{0.6}(\omega o/Vo)\cdot S\cdot R \geqq L \geqq \frac{1}{1.1}(\omega o/Vo)\cdot S\cdot R,$$

wherein

L represents the length (mm) of an arc, concentric with said vertical axis, between an arbitrary point on the horizontal projection radius of a vertical plane including said axis and a corresponding point on the horizontal projection line of said rear wall surface, S represents a distance (mm) measured along a projection on said vertical plane of an imaginary locus along which said bundle of filaments passes when said rotary member is kept stationary, said distance being measured from the intersection of said locus with the vertical axis to a point corresponding to said arbitrary point on the horizontal projection radius, R represents the radial distance (mm) between said vertical axis and said arbitrary point on the horizontal projection radius, Vo represents a predetermined speed (mm/sec) for taking up said filament-bundle, and ωo designates a predetermined rotation speed (radian/sec) of said rotary member.

4. The invention as defined in claim 3 wherein said predetermined speed Vo is in the range of from $2.5\times10^4$ mm/sec. to $8.3\times10^4$ mm/sec.

5. The invention as defined in claim 3 wherein $$\omega_0=2V_0\cos\alpha/D$$

where $\alpha$ is the angle between the bundle of filaments and the horizontal at the discharge opening and D is a predetermined diameter of the coils of bundles of filament in the container.

6. The invention as defined in claim 5 wherein the gradually spreading passage has a bottom wall that extends from the lower part of the front wall to the lower part of the rear wall and is curved outwardly from the end of the gradually spreading passage joined to the lower end of the upper portion and slopes at an $\theta$ to the horizontal at the discharge opening.

7. The invention as defined in claim 6 in which $\alpha$ is approximately equal to $\theta$.

8. The invention as defined in claim 3 wherein a projection of the rear wall of the gradually spreading guide passage onto a vertical plane intersecting said vertical axis is a curved line having a radius of curvature $\rho$ and extending from the vertical upper portion of said guide passage to the peripheral face of said rotary member, said radius of curvature being at least 30 mm, and a tangent to said vertical projection of the rear wall at the discharge opening of said guide passage making an angle $\theta$ with a horizontal plane, which angle is in the range of 5° to 50°.

9. The invention as defined in claim 8 in which $\rho$ is approximately 40 to 150 mm.

10. Apparatus for taking up a bundle of filaments from a supply source and feeding the bundle into a container, the apparatus comprising:

a rotary member mounted for rotation about a vertical axis and having an outer periphery and a guide passage that includes a vertical upper portion extending downwardly from an axial entrance opening at the top of the rotary member and a lower portion that comprises a gradually spreading passage joined to and bent smoothly outwardly from the lower end of the upper portion to a discharge opening at the outer periphery, the gradually spreading passage comprising a rotationally leading front wall and a rotationally trailing rear wall curved away from the leading wall, the arcuate distance of separation between points along the front and rear walls at equal radial distance from the axis being greater the greater the radial distance, and said discharge opening being defined by the surface of the gradually spreading passage and comprising a first area that is adjacent the front wall and is higher than a second area adjacent the rear wall, whereby the main part of the stream of compressed fluid emerges through the first area in a direction above the portion of the bundle of filaments in the container; and ejector means at the upper end of the guide passage to direct a stream of compressed fluid down the vertical upper portion of the guide passage to engage and entrain the bundle of filaments in the upper portion of the guide passage, the increasing arcuate distance of separation of the front and rear walls permitting the bundle of filaments to be pulled toward the rear wall away from the main part of the stream of compressed fluid.

11. Apparatus for taking up a bundle of filaments from a supply source and feeding the bundle into a container, the apparatus comprising:

a rotary member mounted for rotation about a vertical axis and having an outer periphery and a guide passage that includes a vertical upper portion extending downwardly from an axial entrance opening at the top of the rotary member and a lower portion that comprises a gradually spreading passage joined to and bent smoothly outwardly from the lower end of the upper portion to a discharge opening at the outer periphery, the gradually spreading passage comprising a rotationally leading front wall and a rotationally trailing rear wall curved away from the leading wall, the arcuate distance of sepearation between points along the front and rear walls at equal radial distance from the axis being greater the greater the radial distance, said gradually spreading passage having an upper wall extending from the upper part of the front wall to the upper part of the rear wall, and the part of the upper wall adjacent the front wall being higher than the part of the upper wall adjacent the rear wall, said gradually spreading passage having a lower wall extending from the lower part of the front wall to the lower part of the rear wall; and ejector means at the upper end of the guide passage to direct a stream of compressed fluid down the vertical upper portion of the guide passage to engage and entrain the bundle of filaments in the upper portion of the guide passage, the increasing arcuate distance of separation of the front and rear walls permitting the bundle of filaments to be pulled toward the rear wall away from the main part of the stream of compressed fluid.

12. The invention as defined in claim 11 in which the vertical distance between the upper and lower walls at the discharge opening is greater adjacent the front wall than it is adjacent the rear wall.

13. The invention as defined in claim 12 in which the lower wall at the discharge opening is substantially horizontal.

14. The invention as defined in claim 12 in which the lower wall at the discharge opening is tilted downward from the part of the lower wall adjacent the front wall to the part of the lower wall adjacent the rear wall.

15. The invention as defined in claim 1 in which the vertical distance between the upper and lower walls at the discharge opening is approximately constant, whereby the discharge opening is a slot tilted downward from the front wall toward the rear wall.

16. Apparatus for taking up a bundle of filaments from a supply source and feeding the bundle into a container, the apparatus comprising:

a rotary member mounted for rotation about a vertical axis and having an outer periphery and a guide passage that includes a vertical upper portion extending downwardly from an axial entrance opening at the top of the rotary member and a lower portion that comprises a gradually spreading passage joined to and bent smoothly outwardly from the lower end of the upper portion to a discharge opening at the outer periphery, the gradually spreading passage comprising a rotationally leading front wall and a rotationally trailing rear wall curved away from the leading wall, the arcuate distance of separation between points along the front and rear walls at equal radial distance from the axis being greater the greater the radial distance;

a groove in said periphery face of said rotary member extending away from the rear wall of the gradually spreading passage at the discharge opening; and ejector means at the upper end of the guide passage to direct a stream of compressed fluid down the vertical upper portion of the guide passage to engage and entrain the bundle of filaments in the upper portion of the guide passage, the increasing arcuate distance of separation of the front and rear walls permitting the bundle of filaments to be pulled toward the rear wall away from the main part of the stream of compressed fluid.

17. The invention as defined in claim 6 in which the depth of the groove is at least approximately 5 mm and the width of the groove is approximately equal to the width of the bundle of filaments and the length of the groove is approximately equal to $\frac{1}{8}$ to $\frac{1}{2}$ of the circumference of the rotary member at the discharge opening.

* * * * *

UNITED STATES PATENT AND TRADEMARK OFFICE

CERTIFICATE OF CORRECTION

PATENT NO. : 4,392,286

DATED : July 12, 1983

INVENTOR(S) : Satoshi Yakushiji, et al.

It is certified that error appears in the above—identified patent and that said Letters Patent is hereby corrected as shown below:

In the Abstract: line 12, delete "and means" same line 12, delete "which ejects".

Col. 1, line 17, correct spelling of "referred".

Col. 1, line 28, change "speed" to --speeds--.

Col. 1, line 30, delete "been" second occurrence.

Col. 2, line 33, after "tube" insert --is--.

Col. 4, line 1, change "diagramatic" to --diagrammatic--.

Col. 4, line 14, change "Fig. 2." to --Fig. 2;--.

Col. 4, lines 25 and 26, change "perpendicularly" to --perpendicular--.

Col. 4, line 43, change "axes" to --axis--.

Col. 5, line 7, correct spelling of "the".

UNITED STATES PATENT AND TRADEMARK OFFICE

CERTIFICATE OF CORRECTION

PATENT NO. : 4,392,286

DATED : July 12, 1983

INVENTOR(S) : Satoshi Yakushiji, et al

It is certified that error appears in the above-identified patent and that said Letters Patent is hereby corrected as shown below:

Col. 5, line 25, change "inner radially" to -- radially inner --.

Col. 5, line 26, change "outer radially" to -- radially outer --.

Col. 6, line 41, change "toro" to --tow--.

Col. 7, line 6, change "two" to --tow--.

Col. 8, line 6, after "comparison" insert a -- , --.

Col. 16, line 58, change "1" to --11--.

Col. 18, line 10, change "6" to --16--.

Signed and Sealed this

Eighth Day of May 1984

[SEAL]

*Attest:*

*Attesting Officer*

GERALD J. MOSSINGHOFF

*Commissioner of Patents and Trademarks*